US011668498B2

(12) United States Patent
Sung

(10) Patent No.: US 11,668,498 B2
(45) Date of Patent: Jun. 6, 2023

(54) REFRIGERATOR

(71) Applicant: LG ELECTRONICS INC., Seoul (KR)

(72) Inventor: Chiun Sung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 13 days.

(21) Appl. No.: 17/407,535

(22) Filed: Aug. 20, 2021

(65) Prior Publication Data

US 2022/0090830 A1 Mar. 24, 2022

(30) Foreign Application Priority Data

Sep. 22, 2020 (KR) ..... 10-2020-0122480

(51) Int. Cl.
*F25B 39/00* (2006.01)
*F25D 23/00* (2006.01)
*F25B 39/04* (2006.01)

(52) U.S. Cl.
CPC ..... *F25B 39/00* (2013.01); *F25D 23/006* (2013.01); *F25B 39/04* (2013.01)

(58) Field of Classification Search
CPC ..... F25B 39/00; F25B 39/04; F25B 2339/04; F25D 23/006
See application file for complete search history.

(56) References Cited

U.S. PATENT DOCUMENTS

2006/0151160 A1 7/2006 Take
2016/0069595 A1* 3/2016 Kim ..... F25B 13/00
2019/0011172 A1* 1/2019 Hunter ..... F25D 23/003

FOREIGN PATENT DOCUMENTS

JP H10-205919 8/1998
KR 10-2005-0067168 6/2005
KR 10-2015-0098835 8/2015
KR 10-2016-0029636 3/2016
KR 10-2017-0069522 6/2017
KR 20170069522 A * 6/2017 ..... F25B 39/02
(Continued)

OTHER PUBLICATIONS

Pdf is translation of foreign reference WO2019026243A1 (Year: 2019).*

(Continued)

*Primary Examiner* — Henry T Crenshaw
*Assistant Examiner* — Kamran Tavakoldavani
(74) *Attorney, Agent, or Firm* — Ked & Associates, LLP

(57) ABSTRACT

A refrigerator includes a cabinet configured to define a low-temperature storage space and a machine room, in which a compressor is disposed; and a condenser disposed in the machine room. The condenser includes a header comprising a first header and a second header, which are spaced apart from each other, a plurality of tubes configured to connect the first header to the second header, and a heat exchange fin disposed between the tubes spaced apart from each other. The header includes a baffle configured to partition an inner space of the header so as to guide a flow direction of a refrigerant, each of the tubes includes a passage in which a hollow is defined so that the refrigerant flows, and the passage has a volume that gradually decreases along a flow path of the refrigerant.

14 Claims, 6 Drawing Sheets

(56) References Cited

FOREIGN PATENT DOCUMENTS

WO WO-2019026243 A1 * 2/2019 ..... F25B 39/00

OTHER PUBLICATIONS

Pdf is translation of foreion reference KR20170069522A (Year: 2017).*
Korean Notice of Allowance dated May 25, 2022 issued in Application No. 10-2020-0122480.
Korean Office Action dated Nov. 24, 2021 issued in KR Application No. 10-2020-0122480.

* cited by examiner

REFRIGERATOR

CROSS-REFERENCE TO RELATED APPLICATION

This application claims priority under 35 U.S.C. § 119 to Korean Application No. 10-2020-0122480 filed on Sep. 22, 2020, whose entire disclosure is hereby incorporated by reference.

BACKGROUND

1. Field

The present disclosure relates to a refrigerator.

2. Background

In general, refrigerators refer to home appliances in which food may be stored in an internal storage space, which is shielded by a door, at a low temperature. For this, the refrigerator is configured to accommodate the stored food in an optimum state by cooling the internal storage space using cold air generated through heat exchange with a refrigerant circulating in a refrigeration cycle.

The refrigeration cycle includes a compressor that compresses a low-temperature and low-pressure refrigerant into a high-temperature and high-pressure supersaturated gaseous refrigerant, a condenser disposed at an outlet-side of the compressor to condense the high-temperature and high-pressure saturated supersaturated gaseous refrigerant into a high-temperature and high-pressure saturated liquid refrigerant, an expansion device disposed at an outlet-side of the condenser to expand the high-temperature and high-pressure saturated liquid refrigerant into a low-temperature and low-pressure two-phase refrigerant, and an evaporator disposed at an outlet-side of the expansion device to evaporate the low-temperature and low-pressure two-phase refrigerant into a low-temperature and low-pressure gaseous refrigerant.

Recently, a heat exchanger having a micro channel refrigerant tube is known to have superior heat transfer characteristics when compared to other types of heat exchangers, and thus is being used as a condenser of a refrigerator. FIG. 7 is a cross-sectional view illustrating a tube of a micro channel condenser of a condenser according to the related art. As illustrated in FIG. 7, the micro channel refrigerant tube 51 includes a tube body 57 defining an outer appearance thereof, a plurality of passages 58, each of which has a hollow in the tube body 57 so that a refrigerant flows, and a partition wall 59 that partitions the plurality of passages 58.

However, in the structure of the micro channel refrigerant tube 51 according to the related art, all the plurality of passages 58 are designed with the same volume without considering a pressure drop due to the refrigerant that undergoes the phase change while flowing through the micro channel refrigerant tube 51 to cause a limitation in which the refrigerant is not effectively distributed to deteriorate heat dissipation performance.

BRIEF DESCRIPTION OF THE DRAWINGS

The embodiments will be described in detail with reference to the following drawings in which like reference numerals refer to like elements wherein.

DETAILED DESCRIPTION

Figure 1:
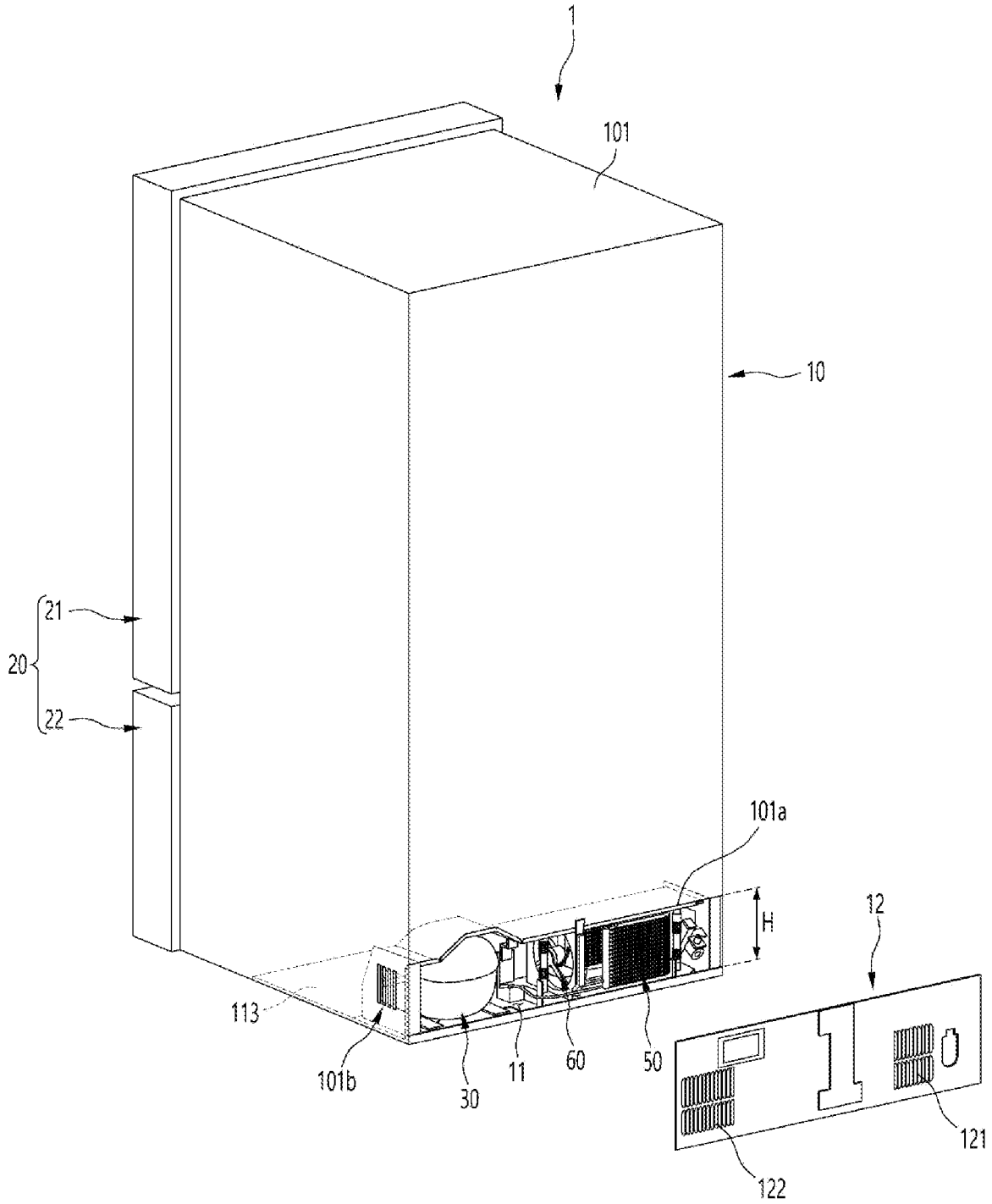
FIG. 1 is a perspective view illustrating a state in which a machine room defined in a rear surface of a refrigerant is opened according to an embodiment.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. In the following description of the present invention, a detailed description of known functions and configurations incorporated herein will be omitted to avoid making the subject matter of the present invention unclear.

In the description of the elements, the terms first, second, A, and B may be used. The terms are merely used to distinguish the corresponding component from other components, and do not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween. In addition, the invention may be embodied in many different forms and should not be construed as being limited to the embodiments set forth herein; rather, that other embodiments included within the scope of the present invention can be easily proposed by adding, changing, or deleting other components.

Figure 2:
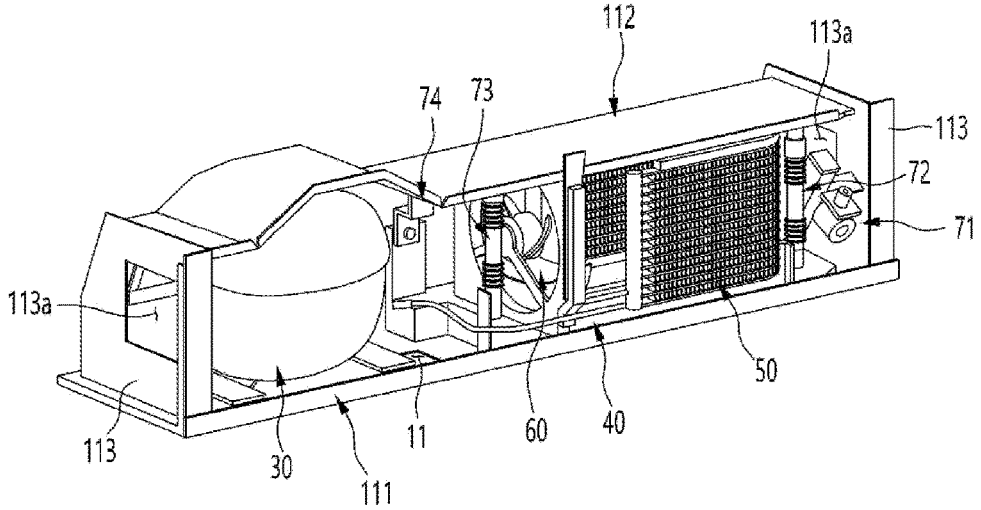
FIG. 2 is a perspective view illustrating an internal structure of the machine room.
Figure 3:
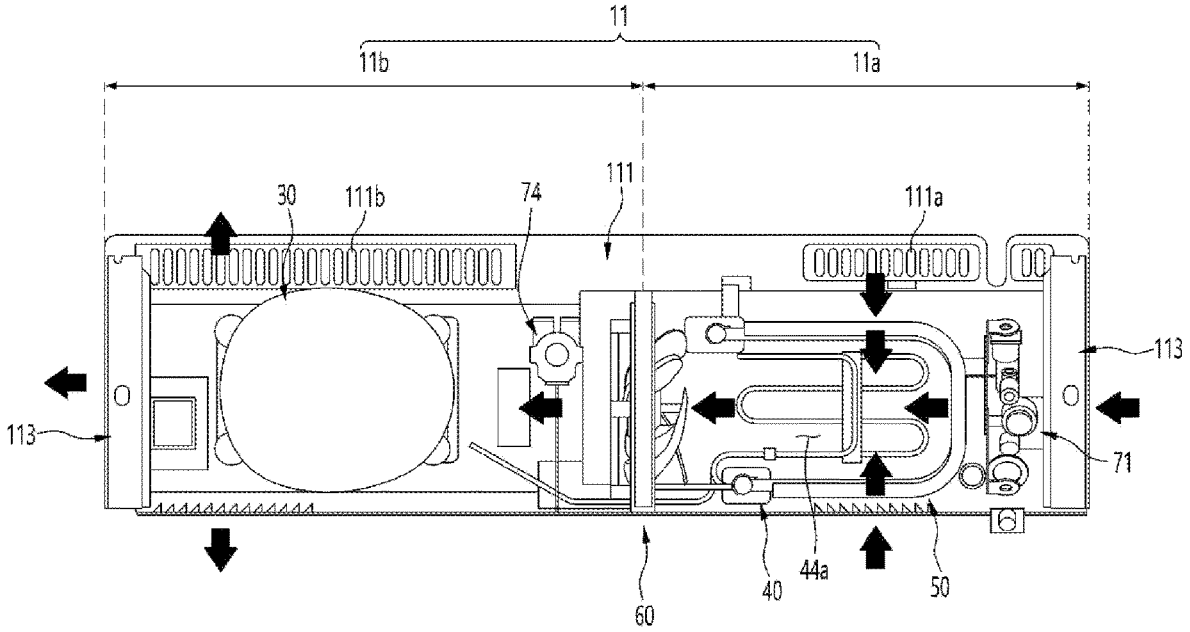
FIG. 3 is a plan view illustrating an air flow state in the machine room.

FIG. 1 is a perspective view illustrating a state in which a machine room defined in a rear surface of a refrigerant is opened according to an embodiment, FIG. 2 is a perspective view illustrating an internal structure of the machine room, and FIG. 3 is a plan view illustrating an air flow state in the machine room. Referring to FIGS. 1 to 3, a refrigerator 1 according to an embodiment may include a cabinet 10 defining a storage space and a door 20 opening and closing the storage space.

Hereinafter, for convenience of understanding, a direction toward the door 20 is defined as a front side, and a direction toward the machine room cover 12 that shields a machine room opening 101*a*, which will be described later, is defined as a rear side. The storage space may be divided up and down or left and right to be constituted by a plurality of spaces and may be cooled to different temperatures to be used as a refrigerating compartment or a freezing compartment.

In addition, the door 20 may be configured to open and close each of the plurality of storage spaces. In addition, the door 20 may be rotatably or slidably mounted on the cabinet 10 to independently open and close each of the storage spaces. In this embodiment, the structure in which, the storage spaces are divided up and down, and the door 20 is also constituted by an upper door 21 and a lower door 22, will be described as an example.

The cabinet 10 may include an outer case 101 defining an outer appearance thereof and an inner case defining a storage space inside the outer case 101. In addition, an insulating material may be filled between the outer case 101 and the inner case to insulate the storage space.

The machine room 11 may be defined at a lower end of a rear surface of the cabinet 10. The machine room 11 may define a space in which a plurality of electrical components including constituents that constitute a refrigeration cycle for cooling the storage space are disposed, and may be partitioned from the storage space to define an independent space. Also, the machine room 11 may communicate with an external space so that the constituents inside the machine room 11 are cooled or heat-exchanged.

In detail, a bottom surface of the machine room 11 may be defined by a bottom plate 111. In addition, a compressor 30 that compresses a refrigerant to supply a high-temperature and high-pressure refrigerant, a condenser 50 that dissipates heat from the high-temperature and high-pressure refrigerant supplied from the compressor 30, and a blower fan unit 60 that allows air within the machine room 11 to forcibly flow may be provided on the bottom plate 111. The compressor 30, the condenser 50, and the blower fan unit 60 may be directly or indirectly mounted on the bottom plate 111.

The inside of the machine room 11 may be divided into left and right with respect to the blower fan unit 60. Here, the condenser 50 may be disposed at the right side in FIG. 1, and the compressor 30 may be disposed on the left side. A right area, on which the condenser 50 is disposed, may be referred to as a suction portion 11*a* through which external air is suctioned, and a left area, on which the compressor 30 is disposed, may be referred to a discharge portion 11*b* through which the external air is discharged.

A machine room cover 12 may be mounted on a machine room opening 101*a* defined in a rear surface of the machine room 11. The machine room cover 12 may define an outer appearance of a portion of each of a rear surface of the machine room 11 and a rear surface of the refrigerator 1 and may shield the machine room opening 101*a* to prevent the constituents inside the machine room 11 from being exposed to the outside.

In one embodiment, the machine room opening 101*a* may have a height H corresponding to a height of an upper end of the condenser 50. A bottom surface of the machine room 11 may be defined by the bottom plate 111, and a top surface including front surface of the machine room 11 may be defined by a top plate 112. In addition, the height H of the opening of the machine room 11 may be defined by a distance between a rear end of the bottom plate 111 and a rear end of the top plate 112 and may have the same as or substantially equal to the height of the condenser 50.

That is, when the machine room cover 12 is opened, the machine room opening 101*a* may be exposed to the outside. Here, the condenser 50 may be mounted and disassembled while being slidably inserted or withdrawn forward, and the condenser 50 may be detachable and mountable through the machine room opening 101*a*. Therefore, even if the height H of the machine room opening 101*a* is substantially the same as the height of the condenser 50, the height and space of the machine room 11 may be minimized without an interference during the assembly and disassembly for service.

The machine room cover 12 may be provided with a suction hole 121 through which the external air is suctioned and a discharge hole 122 through which the air inside the machine room 11 is discharged to the outside. The suction hole 121 may be defined at a position corresponding to the condenser 50, and the discharge hole 122 may be defined at a position corresponding to the compressor 30. Each of the discharge hole 122 and the suction hole 122 may be defined in the form of a grill constituted by a plurality of holes and may be inclined or rounded so that the air suctioned and discharged has directionality.

In addition, a cabinet suction hole (not shown) and a cabinet discharge hole 101*b* may be defined in both side surfaces of the cabinet 10, which correspond to both side surfaces of the machine room 11. The cabinet suction hole may serve as a passage through which the external air is suctioned and may communicate with the suction portion 11*a*, that is, the area in which the condenser 50 is disposed. The cabinet discharge hole 101*b* may serve as a passage through which the air inside the machine room 11 is discharged to the outside and may communicate with the discharge unit 11*b*, that is, the area in which the compressor 30 is disposed.

A side frame 113 defining each of side surfaces of the machine room 11 may be provided on each of left and right surfaces of the bottom plate 111. In addition, a frame suction hole 113*a* and a frame discharge hole 113*b* may be defined in the side frames 113, respectively. Here, the frame suction hole 113*a* may be opened at a position corresponding to the cabinet suction hole (not shown) to communicate with each other, and the frame discharge hole 113*b* may be opened at a position corresponding to the cabinet discharge hole 101*b* to communicate with each other.

In an embodiment, a plate suction hole 111*a* and a plate discharge hole 111*b* may be defined in the bottom plate 111 defining the bottom surface of the machine room 11. The plate suction hole 111*a* may be defined in the area of the suction portion 11*a* and may be horizontally elongated at the front end of the bottom plate 111. In addition, the plate discharge hole 111*b* may be defined in the area of the discharge unit 11*b* and may be horizontally elongated at the front end of the bottom plate 111.

As illustrated in FIG. 3, a suction portion 11*a* and a discharge hole 11*b* may be defined in left and right sides in the entire inside of the machine room 11 by the blower fan unit 60, and thus, the air may be three-dimensionally suctioned and discharged.

In detail, the external air may be forcibly suctioned through the front suction hole 121, the rear plate suction hole 111*a*, and the side cabinet suction hole (not shown) with respect to the condenser 50 and then be introduced into the suction portion 11*a* to pass through the side surfaces of the front and rear surfaces of the condenser 50, which are defined along an inner circumference of the suction portion 11*a*. That is, the external air may pass evenly over the entire surface with respect to the condenser 50 to effectively dissipation heat of the condenser 50.

Also, the air inside the machine room 11 may cool the compressor 30 and then be discharged to the outside through the front discharge hole 122, the rear plate discharge hole 111*b*, and the side cabinet discharge hole 101*b* with respect to the compressor 30. That is, the air discharged by the blower fan unit 60 may cool the compressor 30 while passing through the side compressor 30 and may be discharged to the front, rear, and lateral sides of the discharge portion 11*b*. As described above, since the external air is three-dimensionally supplied to the suction portion 11*a* by an operation of the blower fan unit 60, the condenser 50 may dissipate heat, and after three-dimensionally cooling the compressor 30, the air may be discharged to the outside through the discharge portion 11*b*.

A water valve 71 for supplying water to an ice maker or a dispenser provided in the refrigerator 1 may be provided inside the machine room 11. In addition, an expansion unit 74 (at least one of an expansion valve, an electromagnetic expansion valve, or a capillary tube) for decompressing and evaporating the refrigerant discharged from the condenser 50 may be further provided.

In addition, a base pan 40 on which the condenser 50 is mounted may be provided on the bottom plate 111. In addition, drain hoses 72 and 73 for discharging defrost water generated in the evaporator or a space, in which the evaporator is disposed, to the base pan 40 may be provided vertically above the base pan 40.

A plurality of drain hoses 72 and 73 may be provided according to the number of evaporators and may extend from a position corresponding to the position of the evaporator to a top surface of the base pan 40. The base pan 40 may also be called a drain pan because the defrost water discharged by the drain hoses 72 and 73 is stored.

In an embodiment, the condenser 50 and the base pan 40 may be easily separated and mounted through the machine room opening 101*a* for service even after the machine room 11 is assembled and mounted in the cabinet 10. Particularly, the condenser 50 and the base pan 40 may be accessible the machine room 11 while moving forward through the machine room opening 101*a*. Therefore, the machine room 11 may not require a separate free space for the separate separation and mounting of the condenser 50 and the blower fan unit 60 thereabove, and thus, the machine room 11 may have a minimum height and volume.

Figure 4:
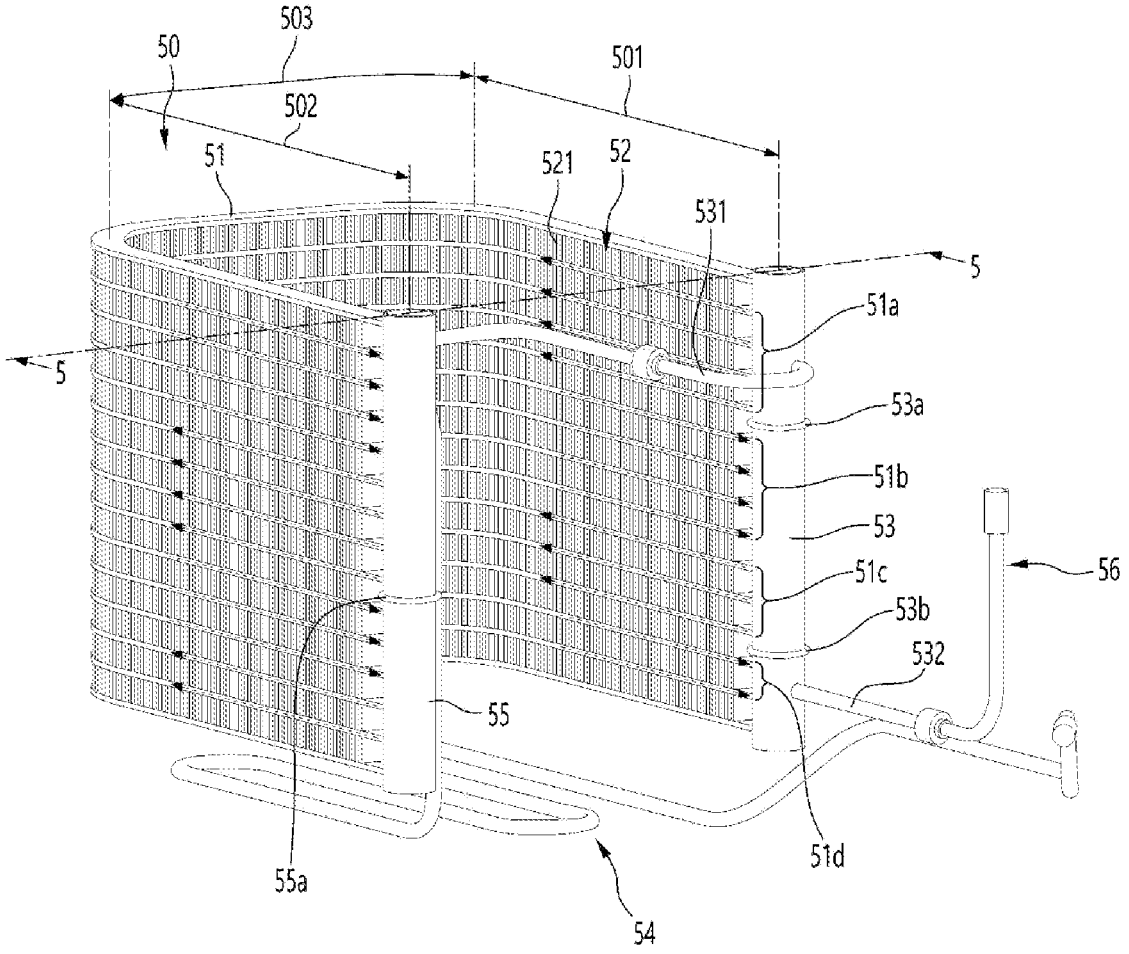
FIG. 4 is a perspective view of a condenser according to an embodiment.
Figure 5:
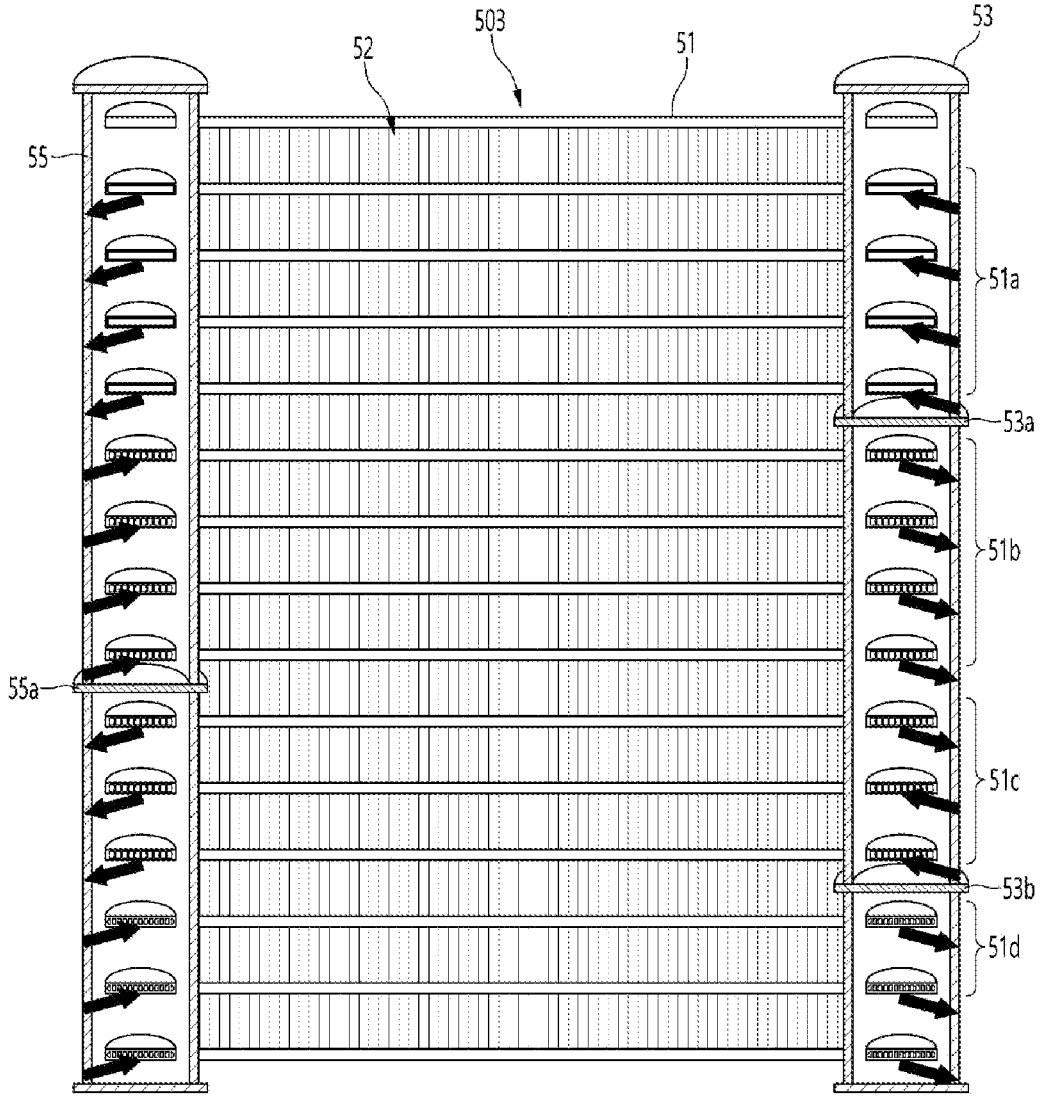
FIG. 5 is a cross-sectional view taken along line 5-5 of FIG. 4.

Hereinafter, the structure of the condenser according to an embodiment will be described in more detail with reference to the drawings. FIG. 4 is a perspective view of the condenser according to an embodiment, and FIG. 5 is a cross-sectional view taken along line 5-5 of FIG. 4. Referring to FIGS. 4 and 5, the condenser 50 may be bent in a shape disposed along the front, rear, and side surfaces of the suction portion 11*a*. The condenser 50 may include a first linear portion 501 extending parallel to the machine room cover 12 from the rear surface of the machine room 11, i.e., a position facing the machine room cover 12, a second linear portion 502 disposed parallel to the first linear portion 501 at a position spaced apart from the first linear portion 501, and a bent portion 503 connecting the first linear portion 501 to the second linear portion 502 and disposed at a position facing the side surface of the machine room 11.

In addition, the condenser 50 vertically extends from the base pan 40 to an upper end of the machine room 11. Thus, all of the air suctioned into the suction portion 11*a* in each direction may pass through the condenser 50 to flow toward the blower fan unit 60.

In detail, the condenser 50 may include a pair of headers 53 and 55, tubes 51 connecting the pair of headers 53 and 55 to each other, and a heat-exchange fin 52 connecting the tubes 51 that are disposed vertically. The above-described configuration may be generally referred to as a micro channel condenser and have a relatively compact size and excellent heat exchange performance.

The pair of headers 53 and 55 may include a first header (or first pipe) 53 and a second header (or second pipe) 55, which are spaced apart from each other in a front and rear direction. For example, the second header 55 may be disposed to be spaced forward from the first header 53. The pair of the headers 53 and 55 may extend vertically at the same height. The first header 53 and the second header 55 may be connected to both ends of the plurality of tubes 51, respectively.

The heat exchange fins 52 may be provided in a space between the plurality of tubes 51. For example, the heat exchange fins 52 may be disposed along the space between the tubes 51 while being continuously bent in a zigzag shape.

Fin openings 521 may be defined between the bent portion of the heat exchange fin 52 and the tubes 51 by the mounting of the heat exchange fin 52. In addition, a contact area of air passing through the fin openings 521, which is defined by the heat exchange fin 52, may increase, and thus, heat exchange efficiency with the refrigerant inside the tube 51 may be improved.

In the first header 53, an input connection portion (or input port) 531 that supplies the refrigerant to the condenser 50 and an output connection portion (or output port) 532 through which the refrigerant is discharged from the condenser 50 may be vertically disposed. For example, the input connection portion 531 may be disposed to be spaced upward from the output connection portion 532. Also, an input tube 54 connected to the compressor 30 may be connected to the input connection portion 531, and an output tube 56 connected to the expansion unit 74 may be connected to the output connection portion 532.

A high-temperature and high-pressure refrigerant introduced through the input connection portion 531 may pass through the plurality of tubes 51 through the first header 53 to flow to the second header 55. In addition, the refrigerant introduced into the second header 55 may be changed in flow direction by the second header 55 and then may pass through the tubes 51 to flow to the first header 53, and finally, may flow to the expansion unit 74 through the output connection portion 532 and the output tube 56.

The tube 51 may be provided in a structure in which one tube 51 is continuously arranged in a horizontal direction with a plurality of channels or passages, and both ends thereof may connect the first header 53 to the second header 55. In addition, the tubes 51 may have the same structure and shape and may be continuously arranged at constant intervals in the vertical direction along the first header 53 and the second header 55.

Baffles 53*a*, 53*b*, and 55*a* may be installed inside the headers 53 and 55. The baffles 53*a*, 53*b*, and 55*a* may partition the refrigerant passages in the headers 53 and 55 to determine a flow path of the refrigerant, which flows to the first header 53 and the second header 55 along the plurality of tubes 51. That is, the headers 53 and 55 may include the baffles 53*a*, 53*b*, and 55*a* that partition inner spaces of the headers 53 and 55 to guide the flow direction of the refrigerant.

At least one of the baffles 53*a*, 53*b*, and 55*a* may be installed to limit a longitudinal flow of the refrigerant flowing through the inside of each of the headers 53 and 55. The baffles 53*a*, 53*b*, and 55*a* may be installed inside the first header 53 and the second header 55 at arbitrary intervals.

The baffles 53*a*, 53*b*, and 55*a* disposed in the first header 53 and the second header 55 may be provided in an arbitrary number and at arbitrary positions. However, the refrigerant is alternately provided in the first header 53 and the second header 55 so that the refrigerant alternately moves between the first header 53 and the second header 55 through the tube 51.

In an embodiment, the baffles 53*a*, 53*b*, and 55*a* may include a first baffle 53*a* and a second baffle 53*b*, which are installed in the first header 53, and a third baffle 55*a* installed in the second header 55. In an embodiment, the first baffle 53*a* and the second baffle 53*b* may be disposed to be spaced apart from each other at a position between the input connection portion 531 and the output connection portion 532 in the first header 53.

For example, the first baffle 53*a* may be spaced apart from an upper portion of the second baffle 53*b*. Therefore, when the input connection portion 531 is disposed to be spaced upward from the output connection portion 532, the first baffle 53*a* and the second baffle 53*b* may be installed at a position between the input connection portion 531 and the output connection portion 532. Also, the first baffle 53*a* may be installed close to the input connection portion 531, and the second baffle 53*b* may be installed close to the output connection portion 532.

In this case, the input connection portion 531 may be disposed above the first baffle 53*a*. In addition, the output connection portion 532 may be disposed below the second baffle 53*b*. In addition, the third baffle 55*a* may be installed at a position between the first baffle 53*a* and the second baffle 53*b* inside the second header 55.

The plurality of tubes 51 may be divided into a plurality of groups adjacent to each other, through which the refrigerant flows in the same direction due to the baffles 53*a*, 53*b*, and 55*a* that change the flow direction of the refrigerant. The tubes 51 may include the plurality of groups through which the refrigerant flows in the first direction from the first header 53 to the second header 55 or the second direction from the second header 55 to the first header 53.

For example, the tubes 51 may include a first tube 51*a* through which the refrigerant introduced through the input connection portion 531 flows in the first direction, a second tube 51*b* through which the refrigerant flows in the second direction, a third tube 51*c* through which the refrigerant flows in the first direction, and a fourth tube 51*d* through which the refrigerant flows to the output connection portion 532 in the second direction. That is, the refrigerant introduced through the input connection portion 531 may sequentially pass through the first tube 51*a* to the fourth tube 51*d* and then be discharged through the output connection portion 532.

In detail, the first tube 51*a* is disposed above the first baffle 53*a*. The refrigerant introduced from the input connection portion 531 through the first tube 51*a* may flow in the first direction. In detail, the refrigerant introduced into the first header 53 through the input connection portion 531 may not be changed in the inflow direction by the first baffle 53*a* to flow in the first direction, which is the same direction as the flow direction.

In addition, the second tube 51*b* may be divided based on the first tube 51*a* and the first baffle 53*a*. In detail, the second tube 51*b* may be disposed below the first baffle 53*a* and above the third baffle 55*a*. In the second tube 51*b*, the refrigerant may flow in the second direction.

In addition, the third tube 51*c* may be divided based on the second tube 51*b* and the third baffle 55*a*. In detail, the third tube 51*c* may be disposed below the third baffle 55*b* and above the second baffle 53*b*. In the third tube 51*c*, the refrigerant may flow in the first direction.

In addition, the fourth tube 51*d* may be divided based on the third tube 51*c* and the second baffle 53*b*. The fourth tube 51*d* may be disposed below the second baffle 53*b*. In the fourth tube 51*d*, the refrigerant may flow in the second direction. The refrigerant passing through the fourth tube 51*d* in the second direction may be discharged through the output connection portion 532 in the same direction.

In more detail, the refrigerant introduced into the first header 53 through the input connection portion 531 passes through the first tube 51*a* in the first direction, which is the same direction as the inflow direction. The refrigerant may pass through the first tube 51*a* in the first direction without flowing to a lower portion of the first header 53 due to the first baffle 53*a* disposed in the first header 53.

In addition, the refrigerant flowing toward the second header 55 flows into the second header 55 by a pressure. Then, the refrigerant passes through the second tube 51*b* in the second direction by the third baffle 55*b*. In this case, the refrigerant may pass through the second tube 51*b* in the second direction by the first baffle 53*a* without flowing to an upper portion of the first header 53.

In addition, the second baffle 53*b* disposed below the first baffle 53*a* inside the first header 53 may be changed into the first direction from the flow direction of the refrigerant in the third tube 51*c*. That is, in the inner space of the first header 53 of which the upper portion is closed by the first baffle 53*a*, and the lower portion is closed by the second baffle 53*b*, the refrigerant is introduced in the second direction and then discharged again in the first direction.

The refrigerant flowing in the first direction flows again to the first header 55 and does not flow upward by the second baffle 53*b*. The refrigerant of which the flow direction is changed by a closed end of the second header 55 passes through the fourth tube 51*d* in the second direction and then is discharged through the output connection portion 532.

When the refrigerant flows in through the input connection portion 531 to flow to the output connection portion 532 by passing through the tube 51, the refrigerant may flow while being changed in phase during the flow process. In detail, the refrigerant is introduced in a state of a high-temperature and high-pressure supersaturated gaseous refrigerant inside the tube 51 through the input connection portion 531 and is phase-changed into a two-phase refrigerant. Then, the refrigerant is finally phase-changed into a high-temperature and high-pressure saturated liquid refrigerant and is discharged to the output connection portion 532.

That is, the gaseous refrigerant, the two-phase refrigerant, and the liquid refrigerant flow in the tube 51 according to the flow order. Thus, the gaseous refrigerant mainly flows through the first tube 51*a*, the two-phase refrigerant mainly flows through the second tube 51*b* and the third tube 51*c*, and the liquid refrigerant mainly flows through the fourth tube 51*d*.

In more detail, the high-temperature and high-pressure supersaturated gaseous refrigerant introduced through the input connection portion 531 passes through the first tube 51*a*. In addition, since the gas phase refrigerant undergoes the phase change in the flow process, the two-phase refrigerant mainly passes through the second tube 51*b* and the third tube 51*c*. In addition, since the two-phase refrigerant undergoes the phase change in the flow process, the liquid refrigerant mainly passes through the fourth tube 51*d* and is discharged to the output connection portion 532.

However, since the gaseous refrigerant has a volume greater than that of the liquid refrigerant at the same mass, when a volume of the passage through which the gaseous refrigerant flows is the same as that of the liquid refrigerant, effective refrigerant distribution is not realized, and thus, the heat dissipation performance is not maximized.

Figure 6:
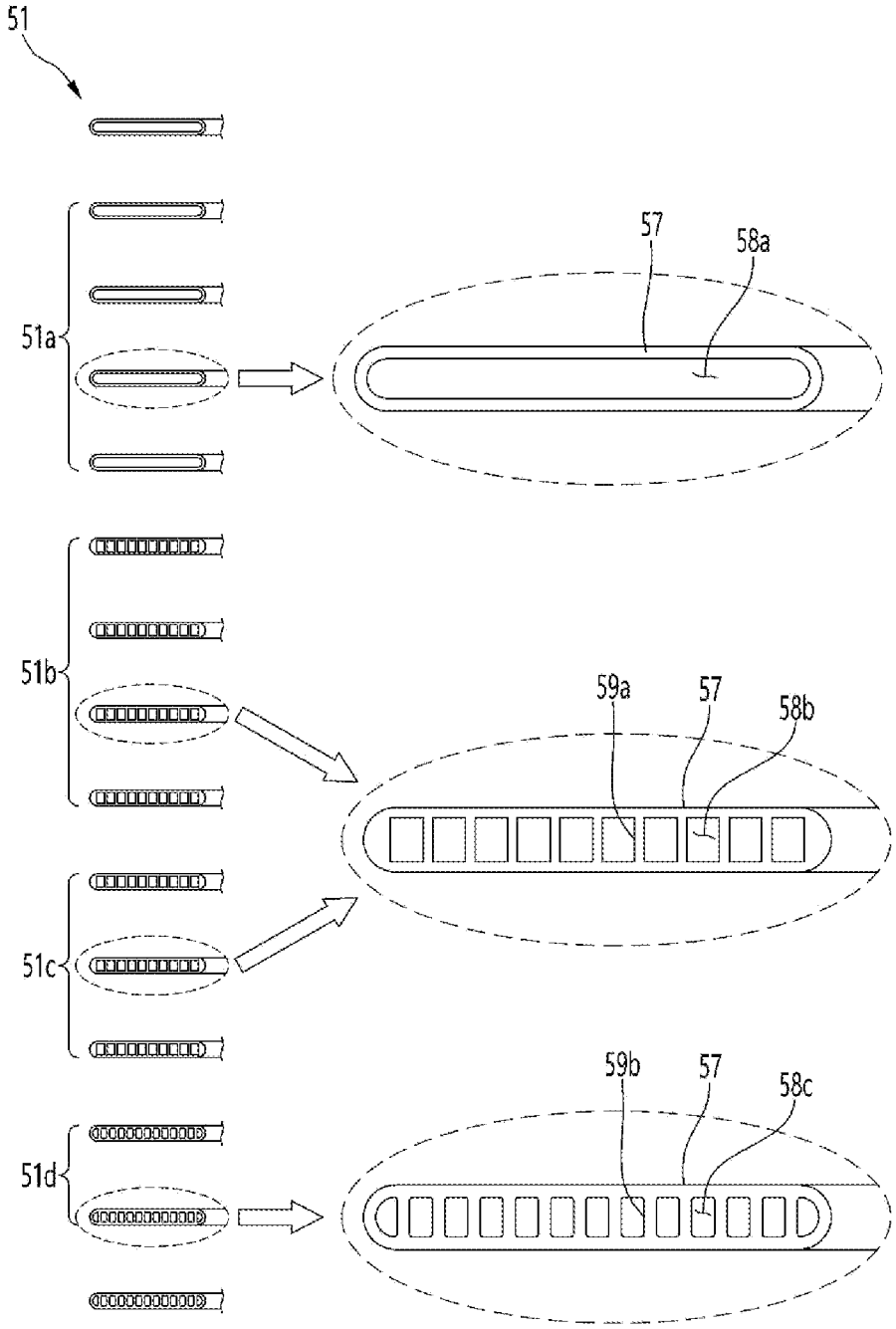
FIG. 6 is a schematic view illustrating a configuration of a tube within a first header in FIG. 5.
Figure 7:
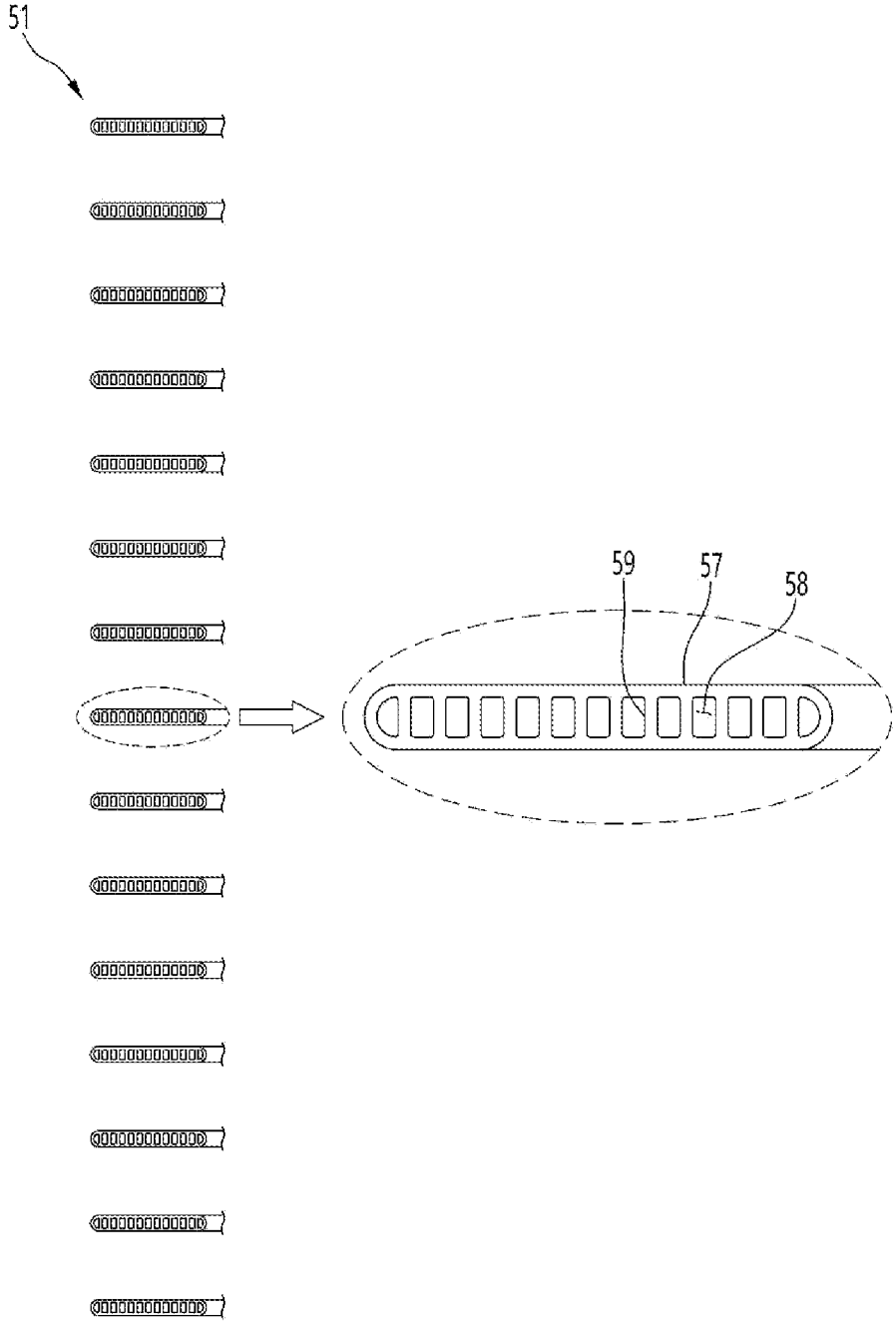
FIG. 7 is a cross-sectional view illustrating a tube of a micro channel condenser according to a related art.

Hereinafter, the internal passage of the tube will be described in more detail with reference to the drawings. FIG. 6 is a schematic view illustrating a configuration of the tube within the first header in FIG. 5. Referring to FIG. 6, the tube 51 may include a tube body 57 defining an outer appearance thereof and a passage 58 defined by hollowing the tube body 57 inside so that the refrigerant flows.

The passage 58 may be provided inside the tube body 57, and at least one or more passages 58 may be provided according to the state of the refrigerant passing through the tubes 51*a*, 51*b*, 51*c*, and 51*d*. In an embodiment, the passage 58 may include a first passage 58*a* provided in the first tube 51*a*, a second passage 58*b* provided in each of the second tube 51*b* and the third tube 51*c*, and a third passage 58*c* provided in the fourth tube 51*d*.

In detail, the refrigerant passing through the first tube 51*a* may mainly flow in a gaseous state. Thus, the first tube 51*a* may include a tube body 57 defining an outer appearance thereof and a first passage 58*a* defined by hollowing the inside of the tube body 57 so that the gaseous refrigerant flows.

The refrigerant passing through the second tube 51*b* and the third tube 51*c* may mainly flow in a two-phase state. In detail, the phase-changed two-phase refrigerant may flow through the second tube 51*b* and the third tube 51*c*. Thus, the second tube 51*b* and the third tube 51*c* have tube bodies 57 defining outer appearances thereof and a plurality of second passages 58*b* defined by hollowing the insides of the tube bodies 57 so that the two-phase refrigerant flows.

In addition, the second tube 51*b* and the third tube 51*c* may further include a first partition wall 59*a* that partitions the plurality of second passages 58*b*. The plurality of second passages 58*b* may be spaced apart from each other in a width direction of the tube body 57 through the first partition wall 59*a*.

The two-phase refrigerant has a volume less than that of the gaseous refrigerant at the same mass. The volume of each of the plurality of second passages 58*b* may be less than that of the first passage 58*a* through the first partition wall 59*a*.

The refrigerant passing through the fourth tube 51*d* may mainly flow in the liquid state. In detail, the liquid refrigerant in which the two-phase refrigerant is phase-changed may flow through the fourth tube 51*d*. Thus, the fourth tube 51*d* may include a tube body 57 defining an outer appearance thereof and a plurality of third flow passages 58*c* defined by hollowing the inside of the tube body 57 so that the liquid refrigerant flows.

In addition, the fourth tube 51*d* may further include a second partition wall 59*b* that partitions the plurality of third passages 58*c*. The plurality of third passages 58*c* may be spaced apart from each other in the width direction of the tube body 57 through the second partition wall 59*b*.

The liquid refrigerant has a volume less than that of the two-phase refrigerant at the same mass. The volume of each of the plurality of third passages 58*c* may be less than that of the second passage 58*b* through the second partition wall 59*b*.

The tube bodies 57 of the tubes 51*a*, 51*b*, 51*c*, and 51*d* may have the same shape. Thus, the volume of each of the flow passages 58*a*, 58*b*, and 58*c* may be determined by the number of partition walls 59*a* and 59*b* provided in the tube body 57.

In an embodiment, as described above, a separate partition wall may not be provided in the first tube 51*a*. Thus, the volume of the first passage 58*a* through which the gaseous refrigerant flows may be greater than that of each of the second passage 58*b* and the third passage 58*c*. However, this embodiment is not limited thereto, and if the volume of the first passage 58*a* is greater than that of each of the second passage 58*b* and the third passage 58*c*, a partition wall may be provided in the first tube 51*a*.

In addition, the number of first partition walls 59*a* that partition the second passage 58*b* may be less than the number of the second partition walls 59*b* that partition the third passage 58*c*. Thus, the volume of the second passage 58*b* may be greater than that of the third passage 58*c*.

As described above, the refrigerator, in which the passage 58 defined in the tube 51 varies in volume according to the state of the refrigerant passing through the passage 58 to improve the heat dissipation performance through the effective refrigerant distribution may be provided.

According to the embodiment having the above-described configuration, the refrigerator, in which the passage defined in the micro channel refrigerant tube varies in volume to improve the heat dissipation performance through the effective refrigerant distribution, may be provided. Particularly, the refrigerator, in which the passage defined in the micro channel refrigerant tube varies in volume according to the state of the refrigerant passing through the passage to improve the heat dissipation performance through the effective refrigerant distribution may be provided.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Embodiments provide a refrigerator, in which a passage defined in a micro channel refrigerant tube varies in volume to improve heat dissipation performance through effective refrigerant distribution. Embodiments also provide a refrigerator, in which a passage defined in a micro channel refrigerant tube varies in volume according to a state of a refrigerant passing through the passage to improve heat dissipation performance through effective refrigerant distribution.

In one embodiment, a refrigerator includes: a cabinet configured to define a low-temperature storage space and a machine room, in which a compressor is disposed; and a condenser disposed in the machine room, wherein the condenser includes: a header comprising a first header and a second header, which are spaced apart from each other; a plurality of tubes configured to connect the first header to the second header; and a heat exchange fin disposed between the tubes spaced apart from each other.

The header may include a baffle configured to partition an inner space of the header so as to guide a flow direction of a refrigerant, each of the tubes may include a passage in which a hollow is defined so that the refrigerant flows, and the passage may have a volume that gradually decreases along a flow path of the refrigerant. The tubes may be classified into a plurality of groups adjacent to each other so that the refrigerant flows in a first direction from the first header to the second header or a second direction from the second header to the first header.

The baffle may include: a first baffle installed in the first header; a second baffle installed in the first head, the second baffle being installed to be spaced apart from the first baffle; and a third baffle installed in the second header, wherein the third baffle may be disposed between the first baffle and the second baffle so that the refrigerant alternately moves to the first header and the second header.

The first header may include: an input connection portion into which the refrigerant is introduced; and an output connection portion which is disposed under the input connection portion to be spaced apart from the input connection portion and through which the refrigerant is discharged, wherein the first baffle and the second baffle may be installed between the input connection portion and the output connection portion, and the first baffle may be installed above the second baffle to be spaced apart from the second baffle.

The tubes may include: a first tube through which the refrigerant introduced through the input connection portion flows along the first direction; a second tube through which the refrigerant passing through the first tube flows along the second direction; a third tube through which the refrigerant passing through the second tube flows along the first direction; and a fourth tube through which the refrigerant passing through the third tube flows to the output connection portion along the second direction. The first tube may be disposed above the first baffle, the second tube may be disposed between the first baffle and the third baffle, the third tube may be disposed between the third baffle and the second baffle, and the fourth tube may be disposed under the second baffle.

The tube may further include a tube body which defines an outer appearance thereof and in which the passage is defined, the passage may include: a first passage defined in the first tube; a plurality of second passages defined in the second tube and the third tube; and a plurality of third passages defined in the fourth tube, and the first passage may have a volume greater than that of each of the second passages and the third passages.

The second tube and the third tube may further include first partition walls configured to partition the plurality of second passages, the fourth tube may further include second partition walls configured to partition the plurality of third passages, and each of the second passages may have a volume greater than that of each of the third passages. The number of first partition walls may be less than that of second partition walls.

In certain examples, aspects of the present specification provide a refrigerator that may comprise: a cabinet configured to define a low-temperature storage space and a machine room, in which a compressor is provided; and a condenser provided in the machine room. The condenser may include: a first header and a second header, which are spaced apart from each other; and a plurality of tubes configured to connect the first header to the second header. At least one of the first header or the second header may include at least one baffle configured to partition an inner space of the at least one of the first header or the second header so as to guide a flow direction of a refrigerant, the tubes may include respective hollow spaces defining passages through which the refrigerant flows, and the passages may have volumes that incrementally decrease along a flow path of the refrigerant.

In certain examples, the tubes and the first and second header may be configured so that the refrigerant flows in a first direction from the first header to the second header or a second direction from the second header to the first header. The baffle may include: a first baffle provided in the first header; a second baffle provided in the first header, the second baffle being spaced apart from the first baffle; and a third baffle provided in the second header, and the third baffle may be provided between the first baffle and the second baffle along the flow path of the refrigerant so that the refrigerant alternately moves to the first header and the second header.

In certain examples, the first header may include: an input connection port into which the refrigerant is introduced; and an output connection port which is provided under the input connection port to be spaced apart from the input connection port and through which the refrigerant is discharged, and the first baffle and the second baffle may be provided between the input connection port and the output connection port, and the first baffle may be installed above the second baffle.

In certain examples, the tubes may include: a first tube through which the refrigerant introduced through the input connection port flows along the first direction; a second tube through which the refrigerant, after passing through the first tube, flows along the second direction; a third tube through which the refrigerant, after passing through the second tube, flows along the first direction; and a fourth tube through which the refrigerant, after passing through the third tube, flows to the output connection port along the second direction. For example, the first tube may be provided above the first baffle, the second tube may be provided between the first baffle and the third baffle, the third tube may be provided between the third baffle and the second baffle, and the fourth tube may be provided under the second baffle.

In certain examples, each of the tubes may include a tube body which defines an outer appearance thereof and in which at least one of the passages is defined, the passages may include a first passage defined in the first tube; a plurality of second passages defined in the second tube and the third tube; and a plurality of third passages defined in the fourth tube, and the first passage may have a volume greater than that of each of the second passages and the third passages.

In certain examples, each of the second tube and the third tube may further include one or more first partition walls configured to partition the hollow spaces of the second tube and the third tube into the plurality of second passages, the fourth tube may further include second partition walls configured to partition the hollow spaces of the fourth tube into the plurality of third passages, and each of the second passages may have a volume greater than that of each of the third passages.

In certain examples, a quantity of the first partition walls may be less than that of the second partition walls. In certain examples, the condenser may further include a heat exchange fin provided between at least two of the tubes. In certain examples, the passages may have a first volume along a first section of the flow path in which the refrigerant received from the input port is in a gas state, a second volume along a second section of the flow path in which the refrigerant is phase-changing between a gas state and a liquid state, and a third volume along a third section of the flow path in which the refrigerant is in a liquid state, the first volume being greater than the second volume, and the second volume being greater than the third volume.

In certain examples, aspects of the present specification provide a condenser that may comprise: a first pipe that extends vertically; a second pipe that extends vertically and is spaced apart from the first tube; and a plurality of tubes configured to extend horizontally to guide a refrigerant between the first pipe and the second pipe, wherein a quantity of passages within the tubes incrementally may increase along a flow path of the refrigerant through the condenser.

In certain examples, the condenser may further comprise: an input port through which the refrigerant is received by the condenser; and an output port through which the refrigerant exits the condenser. For instance, the tubes may include: a first tube through which the refrigerant flows after being received at the input port; a second tube through which the refrigerant flows after passing through the first tube; a third tube through which the refrigerant flows after passing through the second tube; and a fourth tube through which the refrigerant flows after passing through the third tube. For instance, the first tube may include a first quantity of passages that is less than a second quantity of passages included in the second tube, a third quantity of passages in the third tube, and a fourth quantity of passages included in the fourth tube, and the fourth quantity of passages may be greater than the second and third quantities of passages.

In certain examples, the tubes may include tube walls defining hollow spaces through which the refrigerant travels, and the first tube may include only one of the passages defined in a corresponding one of the hollow spaces. In certain examples, the condenser may further comprise: a first baffle provided in the first pipe and configured to direct the refrigerant from the input port toward the second pipe via the first tube; a second baffle provided in the second pipe and configured to direct the refrigerant from first tube toward the first pipe via the second tube, and a third baffle provided in the first pipe, the third baffle being spaced from the first baffle and configured to direct the refrigerant from second tube toward the second pipe via the third tube, wherein the second pipe directs the refrigerant from third tube toward the output port via the fourth tube.

In certain examples, aspects of the present specification provide a condenser that may comprise: an input port through which a refrigerant is received by the condenser; an output port through which the refrigerant exits the condenser; and a plurality of tubes configured to provide a flow path between the input port and the output port, wherein the tubes include: a first tube through which the refrigerant flows after being received at the input port; a second tube through which the refrigerant flows after passing through the first tube; a third tube through which the refrigerant flows after passing through the second tube; and a fourth tube through which the refrigerant flows after passing through the third tube, wherein each of the tubes includes a hollow space through which the refrigerant flows, wherein each of the second, third, and fourth tubes includes at least one partition wall that divides the hollow spaces of the second, third, and fourth tubes into a plurality of passages, and wherein a first quantity of the at least one partition wall included in each of the second and third tubes is less than a second quantity of the at least one partition wall included in the fourth tube. In certain examples, the refrigerant flows in a first horizontal direction in the first and third tubes and flows in a second horizontal direction in the second and fourth tubes.

In certain examples, the condenser may further comprise: a first header that includes the input port and the output port; a second header that is horizontally spaced from the first header; a first baffle provided in the first header and configured to direct the refrigerant from the input port toward second header via the first tube; a second baffle provided in the second header and configured to direct the refrigerant from first tube toward the first header via the second tube, and a third baffle provided in the first header, the third baffle being spaced from the first baffle and configured to direct the refrigerant from second tube toward the second header via the third tube, wherein the second header directs the refrigerant from third tube toward the output port via the fourth tube.

In certain examples, the first tube may not include a partition wall in the hollow spaces of the first tube. In certain examples, each of the second, third, and fourth tubes may include a plurality of the partition walls, and a distance between adjacent pairs of the partitions walls of the second and third tubes may be greater than that of the fourth tube.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet configured to define a low-temperature storage space and a machine room, in which a compressor is provided; and a condenser provided in the machine room, wherein the condenser includes:

a first header and a second header, which are spaced apart from each other; and a plurality of tubes configured to connect the first header to the second header, and wherein:

at least one of the first header or the second header includes at least one baffle configured to partition an inner space of the at least one of the first header or the second header so as to guide a flow direction of a refrigerant, the tubes include respective hollow spaces defining passages through which the refrigerant flows, and the passages have volumes that incrementally decrease along a flow path of the refrigerant, wherein the tubes and the first and second header are configured so that the refrigerant flows in a first direction from the first header to the second header or a second direction from the second header to the first header wherein the baffle includes:

a first baffle installed in the first header;

a second baffle installed in the first header, the second baffle being installed to be spaced apart from the first baffle; and a third baffle installed in the second header, wherein the third baffle is provided between the first baffle and the second baffle along the flow path of the refrigerant so that the refrigerant alternately moves to the first header and the second header, wherein the first header includes:

an input connection port into which the refrigerant is introduced; and an output connection port which is provided under the input connection t to be spaced apart from the input connection port and through which the refrigerant is discharged, wherein the first baffle and the second baffle are installed between the input connection port and the output connection port, and the first baffle is installed above the second baffle, wherein the tubes include:

a first tube through which refrigerant introduced through the input connection port flaws along the first direction;

a second tube through which the refrigerant, after passing through the first tube, flows along the second direction;

a third tube through which the refrigerant, after passing through the second tube, flows along the first direction; and a fourth tube through which the refrigerant, after passing though the third tube, flows to the output connection port along the second direction, and wherein:

the first tube is provided above the first baffle, the second tube is provided between the first baffle and the third baffle, the third tube is provided between the third baffle and the second baffle, and the fourth tube is provided under the second baffle.

2. The refrigerator according to claim 1, wherein each of the tubes includes a tube body which defines an outer appearance thereof and in which at least one of the passages is defined, the passages include:

a first passage defined in the first tube;

a plurality of second passages defined in the second tube and the third tube; and a plurality of third passages defined in the fourth tube, and the first passage has a volume greater than that of each of the second passages and the third passages.

3. The refrigerator according to claim 2, wherein:

each of the second tube and the third tube further includes one or more first partition walls configured to partition the hollow spaces of the second tube and the third tube into the plurality of second passages, the fourth tube further includes second partition walls configured to partition the hollow spaces of the fourth tube into the plurality of third passages, and each of the second passages has a volume greater than that of each of the third passages.

4. The refrigerator according to claim 3, wherein a quantity of the first partition walls is less than that of the second partition walls.

5. The refrigerator according to claim 1, wherein the condenser includes a heat exchange fin provided between at least two of the tubes.

6. The refrigerator according to claim 1, wherein the passages have a first volume along a first section of the flow path in which the refrigerant is in a gas state, a second volume along a second section of the flow path in which the refrigerant is phase changing between the gas state and a liquid state, and a third volume along a third section of the flow path in which the refrigerant is in the liquid state, the first volume being greater than the second volume, and the second volume being greater than the third volume.

7. A condenser comprising:

a first pipe that extends vertically;

a second pipe that extends vertically and is spaced apart from the first pipe;

a plurality of tubes configured to extend horizontally to guide a refrigerant between the first pipe and the second pipe, an input port through which the refrigerant is received by the condenser; and an output port through which the refrigerant exits the condenser, wherein a quantity of passages within the tubes incrementally increases along a flow path of the refrigerant through the condenser, wherein the tubes include:

a first tube through which the refrigerant flows after being received at the input port;

a second tube through which the refrigerant flows after passing through the first tube;

a third tube through which the refrigerant flows after passing through the second tube; and a fourth tube through which the refrigerant flows after passing through the third tube, and wherein the first tube includes a first quantity of passages that is less than a second quantity of passages included in the second tube, a third quantity of passages in the third tube, and a fourth quantity of passages included in the fourth tube, and the fourth quantity of passages is greater than the second and third quantities of passages.

8. The condenser of claim 7, wherein the tubes include tube walls defining hollow spaces through which the refrigerant travels, and the first tube include only one of the passages defined in a corresponding one of the hollow spaces.

9. The condenser of claim 7, further comprising:

a first baffle provided in the first pipe and configured to direct the refrigerant from the input port toward the second pipe via the first tube;

a second baffle provided in the second pipe and configured to direct the refrigerant from first tube toward the first pipe via the second tube, and a third baffle provided in the first pipe, the third baffle being spaced from the first baffle and configured to direct the refrigerant from second tube toward the second pipe via the third tube, wherein the second pipe directs the refrigerant from third tube toward the output port via the fourth tube.

10. A condenser comprising:

an input port through which a refrigerant is received by the condenser;

an output port through which the refrigerant exits the condenser; and a plurality of tubes configured to provide a flow path between the input port and the output port, wherein the tubes include:

a first tube through which the refrigerant flows after being received at the input port;

a second tube through which the refrigerant flows after passing through the first tube;

a third tube through which the refrigerant flows after passing through the second tube; and a fourth tube through which the refrigerant flows after passing through the third tube, wherein each of the tubes includes a hollow space through which the refrigerant flows, wherein each of the second, third, and fourth tubes includes at least one partition wall that divides the hollow spaces of the second, third, and fourth tubes into a plurality of passages, and wherein a first quantity of the at least one partition wall included in each of the second and third tubes is less than a second quantity of the at least one partition wall included in the fourth tube.

11. The condenser of claim 10, wherein the refrigerant flows in a first horizontal direction in the first and third tubes and flows in a second horizontal direction in the second and fourth tubes.

12. The condenser of claim 10, further comprising:

a first header that includes the input port and the output port;

a second header that is horizontally spaced from the first header;

a first baffle provided in the first header and configured to direct the refrigerant from the input port toward second header via the first tube;

a second baffle provided in the second header and configured to direct the refrigerant from first tube toward the first header via the second tube, and a third baffle provided in the first header, the third baffle being spaced from the first baffle and configured to direct the refrigerant from second tube toward the second header via the third tube, wherein the second header directs the refrigerant from third tube toward the output port via the fourth tube.

13. The condenser of claim 10, wherein the first tube does not include a partition wall.

14. The condenser of claim 10, wherein each of the second, third, and fourth tubes includes a plurality of the partition walls, and wherein a distance between adjacent pairs of the partition walls of the second and third tubes is greater than that of the fourth tube.

* * * * *